US011976395B2

(12) United States Patent
Venugopal et al.

(10) Patent No.: US 11,976,395 B2
(45) Date of Patent: May 7, 2024

(54) EMBOSSED NON-WOVEN FOR VEHICLE INTERIOR

(71) Applicant: Carl Freudenberg KG, Weinheim (DE)

(72) Inventors: Arun Prasad Venugopal, Weinheim (DE); Dasa Urbanc, Sencur (SI); Andreja Jurjevcic, Vrhnika (SI); Angela Weik, Bruehl (DE)

(73) Assignee: CARL FREUDENBERG KG, Weinheim (DE)

( * ) Notice: Subject to any disclaimer, the term of this patent is extended or adjusted under 35 U.S.C. 154(b) by 402 days.

(21) Appl. No.: 17/352,390

(22) Filed: Jun. 21, 2021

(65) Prior Publication Data

US 2022/0178058 A1 Jun. 9, 2022

(30) Foreign Application Priority Data

Dec. 4, 2020 (DE) ..... 20 2020 107 011.8
Apr. 26, 2021 (DE) ..... 20 2021 102 212.4

(51) Int. Cl.
*D04H 1/541* (2012.01)
*D04H 1/55* (2012.01)

(52) U.S. Cl.
CPC ..... *D04H 1/5412* (2020.05); *D04H 1/55* (2013.01); *D10B 2331/04* (2013.01); *D10B 2403/011* (2013.01); *D10B 2505/12* (2013.01)

(58) Field of Classification Search
CPC .... D04H 1/5412; D04H 1/55; D10B 2331/04; D10B 2403/011; D10B 2403/012
See application file for complete search history.

(56) References Cited

U.S. PATENT DOCUMENTS

2011/0311795 A1* 12/2011 Bartl ..... D04H 3/007 428/221
2017/0233914 A1* 8/2017 Haverhals ..... C09J 5/00 156/83
2018/0272953 A1 9/2018 Jeon

FOREIGN PATENT DOCUMENTS

DE 102018105164 A1 9/2018
JP H 10251955 A 9/1998
JP 2005054295 A 3/2005
JP 2018058448 A 4/2018
WO WO 2018066169 A1 4/2018

OTHER PUBLICATIONS

Matsunaga et al, JPH10251955A—English Translation, 1997, pp. 1-7 (Year: 1997).*

* cited by examiner

*Primary Examiner* — Maria V Ewald
*Assistant Examiner* — Ethan Weydemeyer
(74) *Attorney, Agent, or Firm* — LEYDIG, VOIT & MAYER, LTD.

(57) ABSTRACT

An embossed non-woven for the vehicle interior, includes: polyethylene terephthalate framework staple fibers; and polyethylene terephthalate binding staple fibers. A proportion of polyethylene terephthalate binding staple fibers is 5 to 50 wt. % based on a total weight of the non-woven. The polyethylene terephthalate binding staple fibers includes core/shell staple fibers. A shell of the core/shell staple fibers has low-melting co-polyethylene terephthalate having a melting point measured in accordance with DIN ISO 11357-3 (2013) in a range of 80° C. to 230° C.

19 Claims, 1 Drawing Sheet

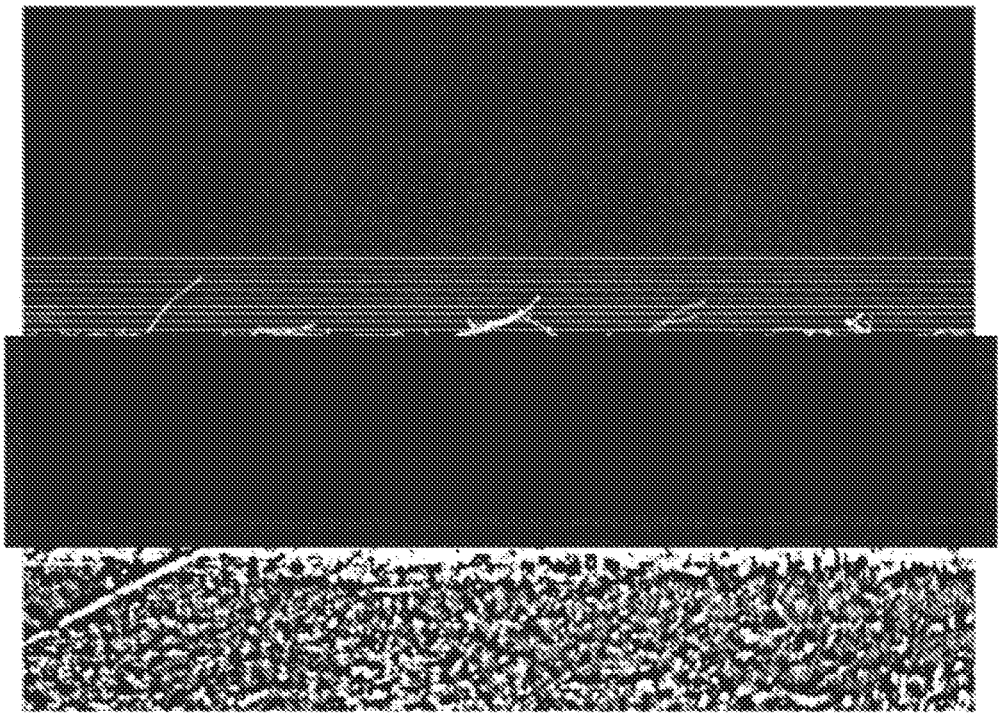

EMBOSSED NON-WOVEN FOR VEHICLE INTERIOR

CROSS-REFERENCE TO PRIOR APPLICATION

Priority is claimed to German Patent Application No. DE 20 2021 102 212.4, filed on Apr. 26, 2021, and to German Patent Application No. DE 20 2020 107 011.8, filed on Dec. 4, 2020. The entire disclosure of both applications is hereby incorporated by reference herein.

FIELD

The present invention relates to an embossed non-woven for the vehicle interior, in particular for a trunk cover, and to a trunk cover for a vehicle which has the non-woven.

BACKGROUND

Currently, materials coated with polyvinyl chloride (PVC) are commonly used for the vehicle interior, in particular for the trunk cover. The use of PVC has the advantage that it has a high surface smoothness, which allows particularly space-saving storage and thus a small thickness in the vehicle. However, it is disadvantageous that it has a comparatively high surface weight and that it releases VOC, in particular in the case of solar radiation. Moreover, because of its usually present composite structure, it is poorly recyclable.

For this reason, there is a need for non-wovens that can be used for the vehicle interior. This is because the use of non-wovens is advantageous in that they make it possible to combine a low surface weight with low or even no VOC emissions.

A non-woven is a structure of fibers of limited length, continuous fibers (filaments), or cut threads of any type and origin that have been joined in some manner into a non-woven (fiber layer, fibrous web) and bonded together in some manner; non-wovens are defined in the ISO 9092/2019 standard. As explained above, non-wovens have advantages for the vehicle interior. However, the use of known non-wovens in the vehicle interior has the disadvantage that they often have a large space requirement due to their fiber structure. Moreover, some customers desire that the vehicle interior material should have as little textile character as possible and little "hairiness" since this can cause a greater resemblance to known products and in addition an increased resistance to abrasion.

DE 102018105164 (A1) discloses a non-woven for a vehicle interior material made by thermocompression molding of a felt, wherein the felt is formed by mixing polyethylene terephthalate (PET) staple fibers and low-melting PET (low-melting polyethylene terephthalate) staple fibers having a melting point in a range of 120 to 140° C. and 150 to 170° C.

SUMMARY

In an embodiment, the present invention provides an embossed non-woven for the vehicle interior, comprising: polyethylene terephthalate framework staple fibers; and polyethylene terephthalate binding staple fibers, wherein a proportion of polyethylene terephthalate binding staple fibers is 5 to 50 wt. % based on a total weight of the non-woven, wherein the polyethylene terephthalate binding staple fibers comprise core/shell staple fibers, and wherein a shell of the core/shell staple fibers has low-melting co-polyethylene terephthalate having a melting point measured in accordance with DIN ISO 11357-3 (2013) in a range of 80° C. to 230° C.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following:

FIG. 1 shows an exemplary profile view of an embossed non-woven.

DETAILED DESCRIPTION

In an embodiment, the present invention provides, starting from DE 102018105164 (A1), a non-woven which is suitable for the vehicle interior and, in particular, for use as a trunk cover. Furthermore, the non-woven material should also be usable with little storage space and be able to be manufactured with only a little or no textile character. If desired, however, the non-woven should also be able to be manufactured with a textile character. In addition, the non-woven should combine a uniform fiber distribution with a good fiber connection and thereby have good mechanical properties and additionally good acoustic properties.

In an embodiment, the present invention provides an embossed non-woven for the vehicle interior, in particular for a trunk cover, comprising polyethylene terephthalate framework staple fibers and polyethylene terephthalate binding staple fibers, wherein the proportion of polyethylene terephthalate binding staple fibers is 5 to 50 wt. % based on the total weight of the non-woven, and wherein the polyethylene terephthalate binding staple fibers are formed as core/shell staple fibers, wherein the shell of the core/shell staple fibers has low-melting co-polyethylene terephthalate having a melting point measured in accordance with DIN ISO 11357-3 (2013) in a range of 80° C. to 230° C. The trunk cover is preferably a trunk cover for a vehicle.

In practical trials, it has been found that the use of core/shell staple fibers in which the shell comprises low-melting co-polyethylene terephthalate having a melting point in a range of 80° C. to 230° C. makes it possible in the non-woven according to the invention to combine a good fiber connection and thereby good mechanical and acoustic properties with good and uniform embossability. It has also been found that a very low coefficient of variation of strength values and thickness can be achieved. In addition, the core/shell binding staple fibers make it possible to equip the non-woven with good elongation even at low thicknesses.

According to the invention, the polyethylene terephthalate binding staple fibers are preferably at least partially thermally fused. A better fiber bond and/or a higher surface smoothness can thereby be obtained.

Without referring to a mechanism, it is assumed that the good fiber connection is achieved in that the core/shell staple fibers make a very homogeneous distribution possible. In particular, "clumping" of the binding component, as is often the case with the use of monocomponent binding fibers, especially in larger amounts, can be avoided. This probably also leads to the observed low coefficient of variation of the strength values and to the good and uniform embossability.

It is furthermore assumed that the good mechanical properties are achieved in that the core of the core/shell staple fibers is retained during the bonding process and can thus contribute to the strength and elongation of the non-woven.

According to the invention, the non-woven is preferably a non-woven in accordance with the ISO 9092/2019 standard. In a preferred embodiment of the invention, the non-woven has a sound absorption coefficient, measured according to DIN ISO 10534-1 (2001), at a wall spacing of 30 mm and at a frequency of 800 Hz to 4000 Hz, preferably of 800 to 2000 Hz, in particular at 2500 Hz, of more than 45%, for example of 45% to 100%, more preferably of more than 60%, for example of 60% to 100%, and more preferably of more than 70%, for example of 70% to 100%, and in particular of more than 80%, for example of 80% to 100%.

The measured sound absorption level above 45% is significantly higher than the sound absorption coefficient of a PVC-based comparative material, which is below 20% at frequencies above 1000 Hz (wall spacing 30 mm). Frequencies of 800 to 4000 Hz are particularly relevant for the automotive interior.

Moreover, in a further preferred embodiment, the non-woven has a sound absorption coefficient (measured according to DIN ISO 10534-1 (2001) at a wall spacing of 30 mm) of more than 45% at at least 6, preferably at least 7, more preferably at least 8 and in particular at least 9 of a total of 19 third intervals in the impedance measurement.

In contrast, a PVC-based comparative material tested in the comparative example has a sound absorption coefficient (measured according to DIN ISO 10534-1 (2001) at a wall spacing of 30 mm) of more than 45% only at 4 of a total of 19 third intervals in the impedance measurement.

In addition, it has been found that the non-woven can be manufactured with only a little textile character or a non-textile character. This can be advantageous since in this way a great similarity to known products, and additionally a good resistance to abrasion and a low soiling behavior can be obtained. In addition, the use of polyethylene terephthalate binding staple fibers in the form of core/shell fibers leads to a very high embossability of the non-woven. At the same time, both the fibers and possibly existing individual layers can be bonded well to one another.

Due to the high stability of the non-woven, it can moreover be manufactured in a small thickness, as a result of which it can also be installed in installation situations with limited installation space. In a preferred embodiment, the non-woven has a thickness, measured according to DIN 9073-2 (1997), test device 1, of 0.3 to 1.2 mm, preferably of 0.4 to 1 mm, more preferably of 0.4 to 0.8 mm, more preferably of 0.4 to 0.7 mm, and in particular of 0.45 to 0.6 mm. The non-woven likewise particularly preferably has a thickness of 0.45 to 0.7 mm. Despite the small thickness, the non-woven can be manufactured with a high elongation. This was surprising since, in particular in the case of embossed non-wovens, a small thickness is generally accompanied by a low elongation, which leads to a paper-like character.

In a further preferred embodiment, the non-woven has a coefficient of variation of thickness below 15%, more preferably below 12% and in particular below 10%.

According to the invention, the shell of the core/shell staple fibers has low-melting co-polyethylene terephthalate. The co-polyethylene terephthalate may be co-polyethylene terephthalate commonly used for core/shell fibers.

The proportion of the low-melting co-polyethylene terephthalate based on the total weight of the shell is preferably above 95 wt. %, in particular above 98 wt. %.

In a preferred embodiment, the ratio between core and shell in the core/shell staple fibers is in the range of 90:10 to 10:90, preferably 80:20 to 20:80, more preferably 70:30 to 30:70, and in particular 60:40 to 40:60.

The core/shell staple fibers can have a great variety of shapes, for example round, trilobal and/or multilobal.

In a further preferred embodiment, the polyethylene terephthalate framework staple fibers and the polyethylene terephthalate binding staple fibers independently have a titer in the range of 1 to 10 dtex, more preferably of 2 to 8 dtex, and in particular of 2 to 7 dtex.

In a further preferred embodiment, the polyethylene terephthalate framework staple fibers and the polyethylene terephthalate binding staple fibers independently have a staple length in the range of 1 to 100 mm, preferably of 10 to 70 mm, more preferably of 20 to 60 mm, and in particular of 30 to 50 mm.

Preferred non-wovens are needled non-wovens and/or non-wovens hardened by water jets. Non-wovens which are needled on both sides and/or hardened on both sides by water jets are particularly preferred since the fibers on both sides can thereby be incorporated particularly well into the non-woven. In a preferred embodiment of the invention, the needle density in the non-woven is from 25 needles/cm$^2$ to 700 needles/cm$^2$, more preferably from 100 needles/cm$^2$ to 600 needles/cm$^2$ and in particular from 200 needles/cm$^2$ to 500 needles/cm$^2$. It has been found that a reduction in the needle density leads to greater fiber flexibility and thus to a better compressibility of the non-woven, which in turn is accompanied by a lower space requirement. It has also been found that adjustment of the needle density to below 25 needles/cm$^2$ can result in insufficient bonding of the fibers in the non-woven.

In a preferred embodiment of the invention, the non-woven has, on one or both sides, an embossing pattern. Preferred embossing patterns are leather imitations, diamonds, prisms and/or textile imitations. More preferably, the non-woven has an embossing pattern applied by means of ultrasound or hot embossing. This can be applied, for example, by an embossing calender. The embossing calender may comprise metal/silicone rollers or else metal/metal rollers, for example. The large degree of design latitude of the embossing patterns is advantageous here. For example, both a geometric and a leather-like surface with corresponding haptics and/or optics can be produced.

The embossing calender can also be used to adjust the desired thickness of the non-woven. Preferred calendering temperatures range from about 80° C. to about 350° C., more preferably from about 125° C. to about 250° C., and more preferably from about 150° C. to about 225° C. Very particularly preferred calendering temperatures are in the range of 150° C. to 350° C., more preferably 180° C. to 350° C., in particular 180° C. to 300° C. This is advantageous in that non-wovens with a particularly low hairiness, a PVC-like character, and a low soiling tendency can be obtained. Preferred calender pressures are in the range of 10 bar to 150 bar, more preferably of 25 bar to 100 bar and in particular of 40 bar to 75 bar. Preferred calendering speeds are in the range of 0.1 m/min up to 50 m/min, preferably 0.5 m/min up to 25 m/min, and in particular 1 m/min up to 20 m/min. It has been found that with the stated calendering conditions, in particular in combination with the needle densities described above, non-wovens with a low thickness in combination with good mechanical properties, in particular good tensile strength and tear resistance can be obtained. Thus, in one embodiment, the non-woven according to the present invention is a calendered non-woven. A particularly preferred non-woven according to the invention is a non-woven which has been calendered at temperatures in the range of 150° C. to 350° C., more preferably 180° C. to 350° C., in particular 180° C. to 300° C. A non-woven which is likewise particularly preferred according to the invention is a non-woven which has been calendered at calendering pressures in the range of 10 bar to 150 bar, more preferably of 25 bar to 100 bar, and in particular of 40 bar to 75 bar. A non-woven which is likewise particularly preferred according to the invention is a non-woven which has been calendered at calendering speeds in the range of 0.1 m/min up to 50 m/min, preferably 0.5 m/min to 25 m/min, and in particular of 1 m/min to 20 m/min. Very particular preference is given to a non-woven which has been calendered in combination with the aforementioned parameters.

A further particularly preferred non-woven according to the invention is a non-woven which has at least on one side a hairiness index of less than 1.50, for example of 0.05 to 1.50, more preferably of 0.05 to 1.40, and in particular of 0.10 to 1.30. The non-woven preferably has the aforementioned hairiness index at least on one embossed side. The non-woven likewise preferably has the aforementioned hairiness index on two embossed sides. The non-woven likewise preferably has the aforementioned hairiness index at least on one embossed and one unembossed side.

Preferably, the non-woven has a longitudinal tensile strength, measured according to EN 29073-03 (1992) (removal speed: 200 mm/min, initial force: 0.5 N, sample width 50 mm), of more than 50 N, for example 50 N to 700 N, more preferably more than 200 N, for example 200 N to 500 N, and in particular more than 300 N, for example 300 N to 450 N. Even more preferably, the non-woven has a longitudinal tensile strength of 250 N to 450 N.

More preferably, the non-woven has a transverse tensile strength, measured according to EN 29073-03 (1992) (removal speed: 200 mm/min, initial force: 0.5 N, sample width 50 mm), of more than 50 N, for example 50 N to 600 N, more preferably more than 200 N, for example 200 N to 500 N, and in particular more than 250 N, for example 250 N to 400 N. The non-woven also particularly preferably has a transverse tensile strength of 250 N to 500 N.

More preferably, the non-woven has a longitudinal and/or a transverse elongation independent of one another, measured according to EN 29073-03 (1992) (removal speed: 200 mm/min, initial force: 0.5 N, sample width 50 mm), of 5 to 50%, more preferably 10 to 40%, and in particular 10 to 30%. Even more preferably, the non-woven has a transverse elongation of 10 to 50%.

More preferably, the non-woven has a longitudinal and/or a transverse tear propagation force independent of one another (removal speed: 200 mm/min, sample width: 50 mm) of more than 5 N, for example 5 N to 100 N, more preferably more than 10 N, for example 10 N to 75 N, and in particular of more than 20 N, for example 20 N to 60 N.

More preferably, the non-woven has a surface weight ISO 9073-1 (1989) of 50 g/m$^2$ to 1000 g/m$^2$, more preferably 100 g/m$^2$ to 500 g/m$^2$, and in particular 150 g/m$^2$ to 350 g/m$^2$. The non-woven likewise preferably has a surface weight (DIN EN 29073-1:1992-08) of 50 g/m$^2$ to 1000 g/m$^2$, more preferably of 100 g/m$^2$ to 500 g/m$^2$ and in particular of 150 g/m$^2$ to 350 g/m$^2$.

More preferably, the non-woven is a transversely laid non-woven. It is advantageous here that particularly uniform mechanical properties are obtainable in both directions (transversely and longitudinally). As mentioned above, the use of the core/shell fibers makes it possible to connect the various layers formed during transverse placement particularly well to one another.

In another embodiment, the non-woven is an airlaid non-woven. This is advantageous in that it can be produced in a particularly cost-effective manner.

In a further preferred embodiment of the invention, the shell of the polyethylene terephthalate binding staple fibers has a melting point as measured in accordance with DIN ISO 11357-3 (2013) in a range of 100 to 200° C., more preferably of 120 to 190° C., and in particular of 150 to 180° C.

In a further preferred embodiment of the invention, the non-woven has a proportion of polyethylene terephthalate binding staple fibers based on the total weight of the non-woven of 10 to 40 wt. % and in particular 15 to 30 wt. %.

In a further preferred embodiment of the invention, the non-woven has a proportion of polyethylene terephthalate framework staple fibers based on the total weight of the non-woven of 50 to 95 wt. %, and in particular of 70 to 85 wt. %.

In a further preferred embodiment, the non-woven is uncoated. This is advantageous since there is better recyclability and the risk of VOC evaporation is reduced as a result. In addition, the production costs can be reduced.

Advantageously, the non-woven has a low VOC value. Preferably, the non-woven has a VOC value, determined according to VDA 278 (2012), of less than 100 μg/g, more preferably less than 50 μg/g, more preferably less than 20 μg/g, more preferably less than 10 μg/g, and in particular less than 5 μg/g.

In a further preferred embodiment, the non-woven is a coated non-woven and has a VOC value, determined according to VDA 278 (2012), of less than 100 μg/g, more preferably less than 50 μg/g, more preferably less than 20 μg/g, and in particular less than 10 μg/g.

Further advantageously, the non-woven is an uncoated non-woven and has a VOC value, determined according to VDA 278 (2012), of less than 100 μg/g, more preferably less than 50 μg/g, more preferably less than 20 μg/g, more preferably less than 10 μg/g, more preferably less than 5 μg/g, more preferably less than 2 μg/g, and in particular less than 1 μg/g.

Advantageously, the non-woven has a low fog value. Preferably, the non-woven has a fog value, determined according to VDA 278 (2012), of less than 400 μg/g, more preferably less than 350 μg/g, more preferably less than 300 μg/g, more preferably less than 275 μg/g, and in particular less than 250 μg/g.

Further advantageously, the non-woven is a coated non-woven and has a fog value, determined according to VDA 278 (2012), of less than 400 μg/g, more preferably less than 300 μg/g, more preferably less than 275 μg/g, and in particular less than 250.

In a further preferred embodiment, the non-woven is an uncoated non-woven and has a fog value, determined according to VDA 278, of less than 100 μg/g, more preferably less than 50 μg/g, more preferably less than 20 μg/g, more preferably less than 10 μg/g, more preferably less than 5 μg/g.

The non-woven may have a coating. In this embodiment, the coating preferably comprises a binder, preferably acrylate, color pigments, thickeners and/or flame retardants. Furthermore, a finishing can be applied to the coating, for example a dirt-repellent and/or water-repellent finishing.

In a preferred embodiment of the invention, the non-woven has a combustibility according to DIN 75200 (1980)

of less than 100 mm/min, more preferably of less than 80 mm/min and in particular of less than 50 mm/min. Most preferably, the non-woven is non-flammable.

In a further preferred embodiment of the invention, the non-woven has a fogging according to DIN 75 201 (2011) (reflectometric) of more than 50%, more preferably of more than 60%, more preferably of more than 70%, and even more preferably of more than 85%, and in particular of more than 90%.

In a further preferred embodiment of the invention, the non-woven has a fogging according to DIN 75 201 (2011) (gravimetric) of less than 2 mg, more preferably of less than 1 mg, more preferably of less than 0.75 mg, and in particular of less than 0.5 mg.

The embossed non-woven is outstandingly suitable for use as a trunk cover for the vehicle interior. For this purpose, the non-woven is preferably packaged. Typical finishing steps include: cutting, for example by means of punching, ultrasonic, laser, water jet, and gelatin cutting; welding, for example by means of ultrasound or heat welding; sewing, for example by means of double stitch stitching, double chain stitching; and/or joining with further components, for example reinforcing components, diaphragms and/or handles.

A further embodiment of the invention comprises the use of the embossed non-woven according to the invention for producing a trunk cover for a vehicle.

A further embodiment of the invention comprises a trunk cover for a vehicle having the non-woven according to the invention.

Testing Methods:

1. Tensile Strength

Tensile Strength is Determined as Follows:

A tensile tester according to DIN 51220 (2003) and DIN EN ISO 7500 (2018) and a punch iron 260×50 mm are used.

Sample Preparation:

The measuring samples are punched out of the existing test specimen uniformly distributed over the width of the product in the longitudinal and transverse directions in each case 10 cm away from the edge.

Procedure:

The measuring sample is uniformly, centrally and perpendicularly clamped, after which the test is carried out in accordance with the machine-specific working instruction, and pulled apart at the predetermined removal speed of 200 mm/min and with an initial force of 0.5 N.

2. Tear Propagation Force

The Tear Propagation Force is Determined as Follows:

A tensile tester according to DIN 51220 (2003) and DIN EN ISO 7500 (2018) and a punch iron 75×50 mm are used.

Sample Preparation:

The measuring samples are punched out of the existing test specimen uniformly distributed over the width of the product in the longitudinal and transverse directions in each case 10 cm away from the edge.

Procedure:

The legs of the measuring sample formed by the cut are clamped at an offset of 180° into the clamping jaws of the tensile tester (clamp spacing 50 mm) and pulled apart at the predetermined removal speed of 200 mm/min. Since non-wovens often do not tear further in the cut direction, it is also necessary to take into account the measuring samples that tear to the side.

3. Determination of the VOC Value

Emissions are determined in accordance with VDA 278 (2012).

4. Determination of Fog Value

Emissions are determined in accordance with VDA 278 (2012).

5. Determination of Fogging Behavior

Fogging is measured in accordance with DIN 75201 (2011).

6. Determination of Melting Point

The melting point is determined in accordance with DIN ISO 11357-3 (2013). The heating rate is 10 K/min.

7. Determination of the Hairiness Index $I_H$

The hairiness index ix serves to describe the surface of a textile. In this case, the number and also the length of the fiber ends protruding from the textile body are measured and, based thereon, a value is issued which evaluates the smoothness of the textile or its hairiness, that is to say whether it has rather few or many protruding fiber ends.

The hairiness index is measured with the aid of a microscope with a camera which produces a profile view of the textile. An exemplary profile view is shown in FIG. 1. Three different measurements at three different zones, left, center and right of the measuring sample, are carried out on a measuring sample with the dimensions 100 mm×14 mm. The width of the textile cutout is 10 mm. For the images, the microscope is set to a magnification of 2.25 at an exposure time of 120 s.

In order to quantify the hairiness of the textile cross-section, horizontal lines with a grid are applied to the image, said horizontal lines being arranged at a distance of 0.082 mm. The first line of the grid begins at a distance of 0.082 mm from the surface line of the textile body. The textile body is defined as the area within which a cohesive textile structure can be seen. The textile body is expediently defined as the area below the first line from above in which, in an optical evaluation, more area covered by fibers than fiber-free area can be seen.

The resulting interfaces between the protruding fibers and the horizontal lines are then counted. It is now necessary to create a regression line in order to obtain a statement about the hairiness of the textile on the basis of the area below the straight line. The greater the surface area, that is to say the definite integral, the hairier the textile since a higher numerical value of the definite integral depends on a higher number and length of fiber ends. From the number of interfaces obtained on a line, the number of fibers to which (at least) the length of this line (i.e., 0.082 mm and the multiples thereof) is assigned as fiber length is ascertained.

In order to now obtain the regression line, the length of the fibers in mm (y-axis) and the number of fibers per piece (x-axis) are shown in a point diagram. Of course, the number of fibers per piece is logarithmized so that a regression line can be applied.

$$F_{ln(n)} = \ln F_n$$

$F_{ln(n)}$ number of fibers n, in ln $F_n$ number of fibers n, per piece

A linear regression is subsequently carried out, wherein the parameters a and b of the linear equation y=ax+b can be calculated by the data $ax_i = \ln n_i$ and $x_i = L_i$.

$$a = \frac{\sum_i x_i y_i - \frac{1}{n}\sum_i x_i \sum_i y_i}{\sum_i x_i^2 - \frac{1}{n}\left(\sum_i x_i\right)^2}$$

-continued $$b = \frac{\sum_i y_i}{n} - a\frac{\sum_i x_i}{n}$$

After the regression line has been calculated and drawn into the diagram, the definite integral is now calculated. The lower limit of the definite integral results from the minimum number of fibers, which in one measurement is the number 1. If this minimum number is logarithmized, a numerical value of 0 results, which in turn defines the lower limit of the integral. The upper limit of the interval is determined on the basis of the zero point xo of the regression line, i.e., at which point of the X-axis the line has the Y value 0. This is calculated by means of the following formula:

$$x_0 = \frac{b}{a}$$

Since the limits of the integral have now also been determined, the surface area below the regression curve can now be ascertained on the basis of the formula.

$$\int_{ln\ 1}^{x_0} ax + bdx$$

The integral values of the 3 measurement zones are averaged and result in the hairiness index $i_H$. The standard deviation is additionally determined.

The invention is explained in more detail below with reference to an example.

Example 1: Production of a Non-Woven According to the Invention

Materials used to produce the non-woven 1

Polyethylene terephthalate framework staple fibers:

80 wt. % of monocomponent PET staple fibers

Staple length: 38 mm

Fineness: 3.3 dTex

Polyethylene terephthalate binding staple fibers:

20 wt. % of bicomponent PET/polyethylene terephthalate binding staple fibers (CoPET staple fibers)

Low-melting CoPET with a melting point of 180° C.

Staple length: 51 mm

Fineness: 4.4 dTex.

The polyethylene terephthalate framework staple fibers and the polyethylene terephthalate binding staple fibers are mixed in the ratio 80%:20% and are then creased, cross-laid, needled, and provided with a leather-like pattern by means of an embossing calender and simultaneously calibrated to a thickness of 0.6 mm.

Example 2: Evaluation of Various Properties of the Non-Woven and Comparison with a PVC-Coated Fabric In the table below, various relevant properties of the non-woven produced in Example 1 (non-woven 1) are shown and compared with those of a PVC-coated fabric.

TABLE 1

| Properties | Unit | Non-woven 1 (inventive) | PVC (not inventive) |
|---|---|---|---|
| Weight (DIN EN 29073-1: 1992-08 for non-woven 1 and EN ISO 2286-2 for PVC) | $g/m^2$ | 200 | 650 |
| Thickness (DIN 9073-2/1997 for non-woven 1 and DIN ISO 2286-3 for PVC) | Mm | 0.6 | 0.6 |
| Elongation (EN 29073-03 (1992) | % | 20 | — |
| Textile character | | Adjustable | No |
| Sound absorption coefficient measured at 2500 Hz (DIN ISO 10534-1 (2001)) | % | 99 | 14 |
| VOC value (VDA 278 (2012)) (Total)* | µg/g | <0.1 | 114* |
| Fog value VDA 278 (2012)** | µg/g | 4.9 | 482** |
| Fogging (DIN 75201 (2011)) reflectrometric | % | 99.7 | 85.4 |
| Fogging (DIN 75201 (2011)) gravimetric | Mg | 0.11 | 0.86 |

*The following emissions were found: acetate, di-t-butyl cyclohexadienedione, sulfate esters, i-alkene mixture, i-alkene, stearyl alcohol, dibutyl phthalate, fatty acid esters, fatty alcohols, DOP.

**The following emissions were found: perfluorinated alcohol, butanone oxime, phosphonic acid ester, phosphonate, alcohols, nonanoic acid, DOA, camphene, carene or pinene, ethyl stearate, fatty alcohols, fatty acids, DOP, alkene mixture, diisononyl phthalate, TMDD, KW mixture, etc.

It has been found that the non-woven according to the invention can be manufacture with a low thickness and nevertheless satisfactory mechanical properties, in particular of a high elongation, as a result of which it is suitable for use in the vehicle interior even given low storage space. This was surprising since, in particular in the case of embossed non-wovens, a small thickness is generally accompanied by a low elongation, which leads to a paper-like character. Furthermore, the non-woven according to the invention can be manufactured with or without textile character. Moreover, the non-woven exhibits a particularly uniform fiber distribution with a good fiber connection and thereby good mechanical properties.

Lastly, the non-woven according to the invention exhibits a very high sound absorption coefficient, measured at 2500 Hz, which is markedly higher than that of PVC.

Example 3: Production of Non-Woven 2 According to the Invention

Materials used to produce the non-woven 2

Polyethylene terephthalate framework staple fibers:

80 wt. % of monocomponent PET staple fibers

Staple length: 38 mm

Fineness: 1.7 dTex

Polyethylene terephthalate binding staple fibers:

20 wt. % of bicomponent PET/polyethylene terephthalate binding staple fibers (CoPET staple fibers)

Low-melting CoPET with a melting point of 180° C.

Staple length: 51 mm

Fineness: 4.4 dTex.

The polyethylene terephthalate framework staple fibers and the polyethylene terephthalate binding staple fibers are mixed at the ratio 80%:20% and are subsequently creased, cross-laid, needled, and provided with a leather-like pattern by means of an embossing calender and simultaneously calibrated to a thickness of 0.7 mm.

Example 4: Production of Two Comparative Non-Wovens with Monocomponent Staple Fibers Materials used to produce comparative non-wovens 3 and 4

Polyethylene terephthalate framework staple fibers:
80 wt. % of monocomponent PET staple fibers
Staple length: 38 mm
Fineness: 1.7 dTex
Monocomponent staple fibers:
20 wt. % of (for comparative non-woven 3)
10 wt. % of (for comparative non-woven 4)
Low-melting CoPET with a melting point of 170° C.
Staple length: 60 mm
Fineness: 5.5 dTex.

The polyethylene terephthalate framework staple fibers and the monocomponent staple fibers are mixed at a ratio of 80%:20% (for comparative non-woven 3) and at a ratio of 90%:10% (for comparative non-woven 4), and are subsequently creased, cross-laid, needled, and provided with a leather-like pattern by means of an embossing calender and simultaneously calibrated to a thickness of 0.7 mm.

Example 5: Evaluation of Various Mechanical Properties of Non-Woven 2 and Comparison to Comparative Non-Wovens 3 and 4

TABLE 2

| Properties | Unit | Non-woven 2 (inventive) | Comparative non-woven 3 | Comparative non-woven 4 |
|---|---|---|---|---|
| Weight (DIN EN 29073-1: 1992-08) | $g/m^2$ | 195.4 | 195.8 | 195.2 |
| Thickness (DIN 9073-2/1997) | mm | 0.66 | 0.72 | 0.69 |
| Variation coefficient (thickness) | % | 8.58 | 22.82 | 16.15 |
| Longitudinal tensile strength (EN 29073-03 (1992) | N | 264.06 | 248.50 | 220.48 |
| Variation coefficient (longitudinal tensile strength) | % | 7.40 | 25.61 | 14.13 |
| Transverse tensile strength (EN 29073-03 (1992) | N | 485.14 | 429.04 | 430.17 |
| Variation coefficient (transverse tensile strength) | % | 1.75 | 4.39 | 5.39 |
| Longitudinal elongation (EN 29073-03 (1992) | % | 17.80 | 20.72 | 87.86 |
| Transverse elongation (EN 29073-03 (1992) | % | 44.65 | 55.14 | 69.58 |
| Longitudinal tear propagation force DIN 51220 (2003) | N | 51.82 | 44.35 | 47.91 |
| Variation coefficient (longitudinal tear propagation force) | % | 2.2 | 10.59 | 8.39 |
| Transverse tear propagation force DIN 51220 (2003) | N | 30.52 | 26.25 | 24.02 |
| Variation coefficient (transverse tear propagation force) | % | 3.28 | 11.74 | 7.30 |
| Hairiness index $i_H$ | — | 0.26 | 1.83 | 2.92 |
| Variation coefficient (hairiness index $i_H$) | — | 0.13 | 0.27 | 0.78 |

It can be seen that the non-woven 2 according to the invention has overall better mechanical properties with regard to tensile strength, elongation, and tear propagation force than the comparative non-wovens 3 and 4. Moreover, the variation coefficients for tensile strength, tear propagation force and thickness are lower. It is assumed that the lower variation coefficient of the thickness of the non-woven according to the invention compared to the comparative non-wovens 3 and 4 is due to the fact that the monocomponent staple fibers are non-uniformly distributed in the non-woven and have a higher tendency to concentrate at the surface of the non-woven. This leads to a partially stronger adhesion to the calender, which in turn leads to a more irregular thickness. On the other hand, the core/shell staple fibers allow a very homogeneous distribution. In particular, "clumping" of the binding component, as is often the case with the use of monocomponent binding fibers, especially in larger amounts, can be avoided and a high degree of uniformity of the thickness can be achieved. Lastly, the non-woven according to the invention has a significantly lower hairiness.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. An embossed non-woven for a vehicle interior, comprising:

polyethylene terephthalate framework staple fibers; and polyethylene terephthalate binding staple fibers, wherein a proportion of polyethylene terephthalate binding staple fibers is 5 to 50 wt. % based on a total weight of the non-woven, wherein the polyethylene terephthalate binding staple fibers comprise core/shell staple fibers, wherein a shell of the core/shell staple fibers has low-melting co-polyethylene terephthalate having a melting point measured in accordance with DIN ISO 11357-3 (2013) in a range of 80° C. to 230° C., and wherein the embossed nonwoven fabric has a thickness, measured accordingly to DIN 9073-2 (1997), test device 1, of 0.3 to 1.2 mm.

2. The embossed non-woven of claim 1, wherein the non-woven has a sound absorption coefficient as measured in accordance with DIN ISO 10534-1 (2001) at a wall spacing of 30 mm and at a frequency of 800 Hz to 4000 Hz of over 45%.

3. The embossed non-woven of claim 1, wherein the non-woven has a thickness, measured of DIN 9073-2 (1997), test device 1, of 0.4 to 1 mm.

4. The embossed non-woven of claim 1, wherein a quantitative mass ratio between core and shell in the core/shell staple fibers is in a range of 90:10 to 10:90.

5. The embossed non-woven of claim 1, wherein the polyethylene terephthalate framework staple fibers and the polyethylene terephthalate binding staple fibers independently have a titer in a range of 1 to 10 dtex.

6. The embossed non-woven of claim 1, wherein the polyethylene terephthalate framework staple fibers and the polyethylene terephthalate binding staple fibers independently have a staple length in a range of 1 to 100 mm.

7. The embossed non-woven of claim 1, wherein the non-woven comprises a needled non-woven and/or a non-woven hardened by water jets.

8. The embossed non-woven of claim 1, wherein the non-woven has a longitudinal tensile strength, measured of EN 29073-03 (1992) (removal speed: 200 mm/min, initial force: 0.5 N, sample width 50 mm) of more than 50 N, and/or by a transverse tensile strength, measured of EN 29073-03 (1992) (removal speed: 200 mm/min, initial force: 0.5 N, sample width 50 mm), of more than 50 N.

9. The embossed non-woven of claim 1, wherein the non-woven has a longitudinal and/or a transverse tear propagation force independent of one another, measured according to EP 29073-03 (1992) (removal speed: 200 mm/min, sample width: 50 mm), of more than 5 N.

10. The embossed non-woven of claim 1, wherein the non-woven has a surface weight of ISO 9073-1 (1989) of 50 $g/m^2$ to 1000 $g/m^2$.

11. The embossed non-woven of claim 1, wherein the non-woven has a longitudinal and/or a transverse elongation independent of one another, measured according to EN 29073-03 (1992) (removal speed: 200 mm/min, initial force: 0.5 N, sample width 50 mm), of 5 to 50%.

12. The embossed non-woven of claim 1, wherein the non-woven has a proportion of polyethylene terephthalate binding staple fibers of 10 to 40 wt. %.

13. The embossed non-woven of claim 1, further comprising:

a coating, wherein the coating comprises a binder, color pigments, thickeners, and/or flame retardants.

14. The embossed non-woven of claim 1, wherein the non-woven has, on one or both sides, an embossing pattern.

15. The embossed non-woven of claim 1, wherein the non-woven has, at least on one side, a hairiness index of less than 1.50.

16. A trunk cover for a vehicle, comprising:

the non-woven of claim 1.

17. The embossed non-woven of claim 2, wherein the sound absorption coefficient is more than 60%.

18. The embossed non-woven of claim 17, wherein the sound absorption coefficient is more than 70%.

19. The embossed non-woven of claim 2, wherein the sound absorption coefficient is measured at a frequency of 800 to 2000 Hz.

* * * * *